United States Patent [19]

Sarcia

[11] Patent Number: 4,471,626

[45] Date of Patent: Sep. 18, 1984

[54] CRYOGENIC REFRIGERATOR

[75] Inventor: Domenico S. Sarcia, Carlisle, Mass.

[73] Assignee: CVI Incorporated, Columbus, Ohio

[21] Appl. No.: 499,587

[22] Filed: May 31, 1983

Related U.S. Application Data

[63] Continuation-in-part of Ser. No. 398,482, Jul. 15, 1982, Pat. No. 4,438,631.

[51] Int. Cl.[3] ..... F25B 9/00

[52] U.S. Cl. ..... 62/6; 60/520

[58] Field of Search ..... 62/6; 60/517, 518, 519, 60/520

[56] References Cited

U.S. PATENT DOCUMENTS

| | | | |
|---|---|---|---|
| 3,421,331 | 1/1969 | Webb | 62/6 |
| 3,625,015 | 12/1971 | Chellis | 62/6 |
| 3,812,682 | 5/1974 | Johnson | 62/6 |
| 4,092,829 | 6/1978 | Durenec | 62/6 |
| 4,180,984 | 1/1980 | Chellis | 62/6 |
| 4,333,755 | 5/1982 | Sarcia | 62/6 |
| 4,388,809 | 6/1983 | Sarcia | 62/6 |

*Primary Examiner*—Ronald C. Capossela

*Attorney, Agent, or Firm*—Seidel, Gonda & Goldhammer

[57] ABSTRACT

A cryogenic refrigeration is disclosed for operation in a first mode wherein an electrical motor reciprocates a displacer, and in a second mode wherein the displayer is reciprocated by both the motor and fluidic pressure, and in a third mode wherein the displacer is reciprocated by fluidic pressure.

14 Claims, 3 Drawing Figures

CRYOGENIC REFRIGERATOR

REFERENCE TO CO-PENDING APPLICATION

This application is a continuation-in-part of application Ser. No. 398,482 filed July 15, 1982 and entitled Cryogenic Refrigerator now U.S. Pat. No. 4,438,631.

BACKGROUND

The present invention differs from the refrigerator disclosed in the above mentioned application in a number of respects. The refrigerator of the present invention is a hybrid in that the slide connected to the displacer is always subjected at one end to a pressure intermediate the high and low pressures to which the displacer is subjected. There is no axial central passage in the slide connected to the displacer of the present invention. The present invention provides for a displacer having minimal eccentric forces applied thereto when in the hybrid mode and no eccentric forces when in the fluidic mode whereby it may be of a larger diameter with only one bearing.

There is a need for a cryogenic refrigerator which can operate in magnetic fields which are of a magnitude whereby the field would interfere with proper operation of an electrical synchronous motor. An example of a device having such a field is a nuclear magnetic resonance body scanner. In such a device, the refrigerator cools the shields around a super conducting magnet. The refrigerator in said pending application cannot operate in such a field. The present invention may operate in such a field.

SUMMARY OF THE INVENTION

The present invention is directed to a cryogenic refrigerator in which a movable displacer means defines within an enclosure first and second chambers of variable volume. A refrigerant fluid is circulated in a fluid path between the first chamber and the second chamber by movement of the displacer means. A slide or piston is connected to the displacer means and guided for reciprocation. A A motor is connected to the slide or piston for reciprocating the same. A valve having a reciprocable valve member is provided for controlling the flow of high and low pressure fluid to and from said chambers. The motor is arranged to reciprocate the valve member in timed relation with reciprocation of the piston or slide so that the valve member will reverse the introduction of high pressure fluid into the first and second chambers when the displacer means is at one of the extremities of its movement. A third chamber is provided and exposed to a face of the piston or slide. A means is provided in association with conduits for the high and low pressure fluids for maintaining the pressure in the third chamber intermediate the high and low pressures.

Various objects and advantages will be set forth hereinafter.

For the purpose of illustrating the invention, there is shown in the drawings a form which is presently preferred; it being understood, however, that this invention is not limited to the precise arrangements and instrumentalities shown.

DETAILED DESCRIPTION

Figure 1:
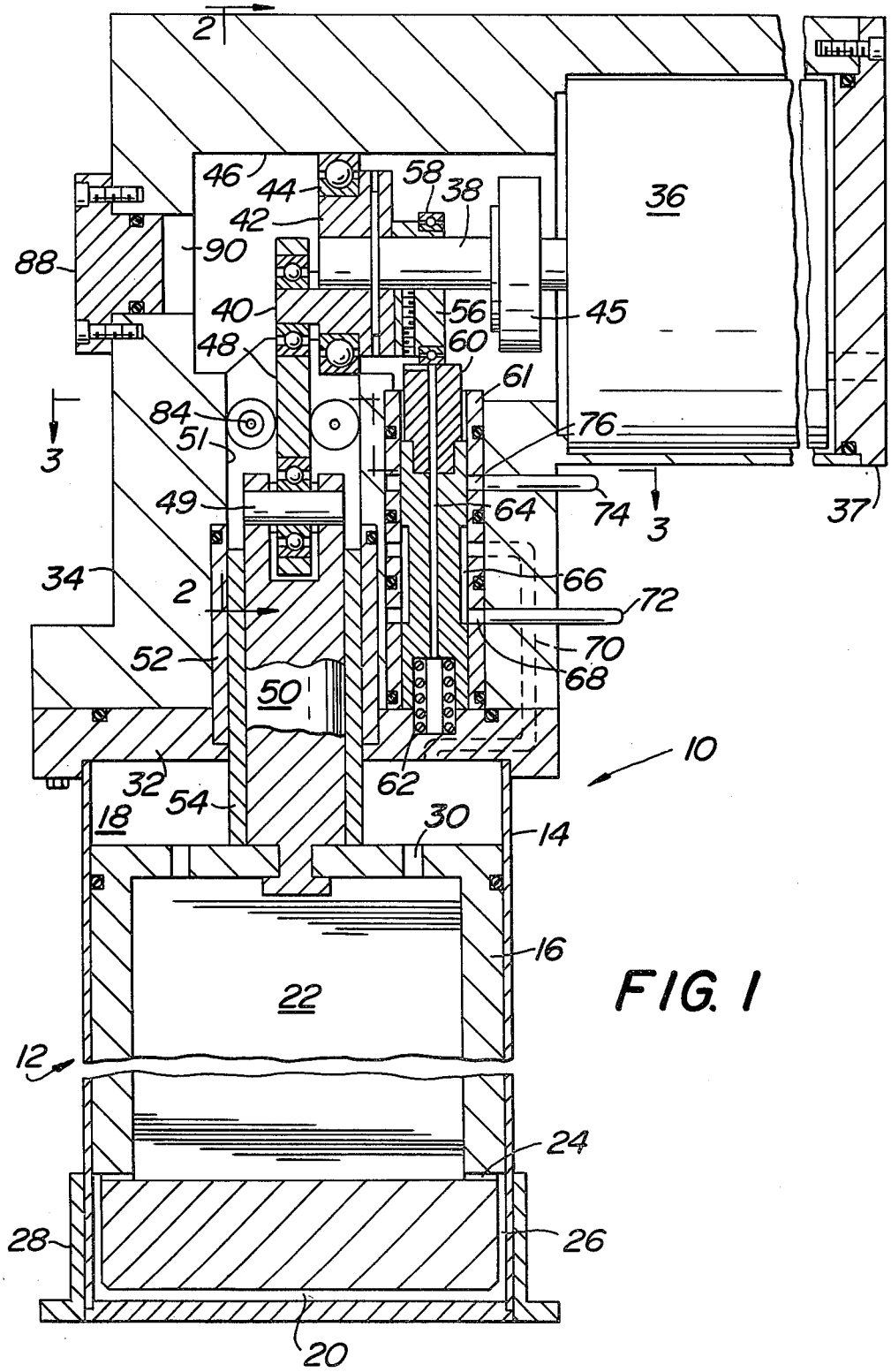
FIG. 1 is a vertical section of view through a refrigerator in accordance with the present invention.

Referring to the drawing in detail, wherein like numerals indicate like elements, there is shown in FIG. 1 a cryogenic refrigerator in accordance with the present invention and designated generally as 10. As illustrated, the refrigerator 10 has a first stage 12. It is within the scope of the present invention to have one or more stages. When in use, the stages are disposed within a vacuum housing not shown. Each stage includes a housing 14 within which is provided a displacer 16. The displacer 16 has a length less than the length of the housing 14 so as to define a warm chamber 18 thereabove and a cold chamber 20 therebelow. The designations warm and cold are relative as is well known to those skilled in the art. Within the displacer 16, there is provided a regenerator 22 containing a matrix. Port 30 communicate the upper end of the matrix in regenerator 22 with the warm chamber 18. Radially disposed ports 24 communicate the lower end of the matrix in regenerator 22 with a clearance space 26 disposed between the outer periphery of the lower end of the displacer 16 and the inner periphery of the housing 14. Thus, the lower end of matrix in regenerator 22 communicates with the cold chamber 20 by way of ports 24 and clearance 26 which is an annular gap heat exchanger.

The matrix in regenerator 26 is preferably a stack of 250 mesh material having high specific heat such as oxygen-free copper. The matrix has low void area and low pressure drop. The matrix may be other material such as lead spheres, nylon, glass, etc.

A heat station 28 is attached to the lower end of the housing 14. The upper end of the housing 14 is attached to a header 32. Header 32 is removably bolted to a housing 34. Housing 34 has a bore closed at one end by removable cover 37 and adapted to contain an electrical synchronous motor 36.

Motor 36 has an output shaft 38. A roller 42 is pinned to shaft 38 and has an eccentric pin 40. Roller 42 has bearing 44 attached to its outer periphery for contact with the bore 46. Flywheel 45 is attached to shaft 38.

The pin 40 extends into an annular roller bearing supported by the upper end of a link 48. The lower end of link 48 contains a roller bearing surrounding a pin 49 on the upper end of a slide or piston 50. The lower end of piston 50 is attached to the displacer 16. A ceramic clearance seal sleeve bearing 54 is attached to the outer periphery of piston 50. A similar sleeve bearing 52 is retained in a groove of the bore 51 and is held in place by a shoulder on housing 34 and a shoulder on header 32.

A cam 56 is adjustably attached to the motor shaft 38 by a set screw of other equivalent device. A roller bearing 58 is attached to the outer periphery of cam 56. As cam 56 is rotated, it controls the operation of a valve having a reciprocable valve member 60. Cam 56 contacts one end of valve member 60. A coil spring 62 is disposed in a chamber at the opposite of valve member 60. The last mentioned chamber communicates with bore 46 by way of a central passage 64 in the valve member 60.

The valve member 60 is provided with a peripheral groove 66. Groove 66 has an axial length sufficient so as to bridge the high pressure inlet port 68 and a port which communicates passage 70 with the warm chamber 18 as shown in FIG. 1. A high pressure inlet conduit 72 communicates with the port 68. A low pressure conduit 74 communicates with the low pressure port 76. When cam 56 is 180 degrees out of phase from that illustrated in FIG. 1, groove 66 communicates port 76 with passage 70.

Figure 3:
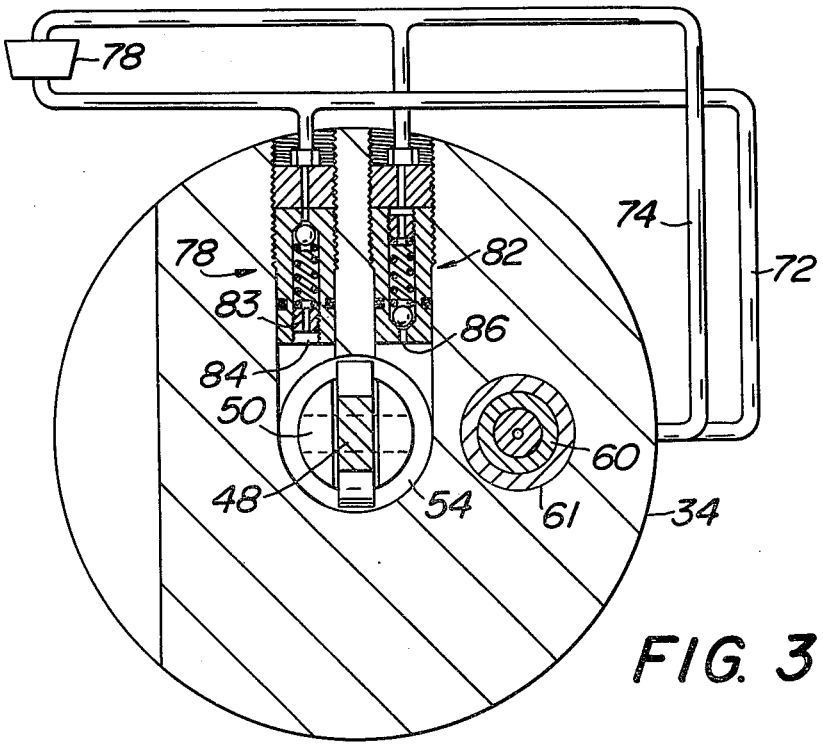
FIG. 3 is a sectional view taken along the line 3—3 in FIG. 1.

Referring to FIG. 3, it will be noted that the conduits 72 and 74 communicate with a compressor 78. A valve means 80 provides communication between high pressure conduit 72 and the interior of bore 46 as well as any portion of the bore 51 above the elevation of the piston 50. A similar valve means 82 provides communication between said bores and low pressure conduit 74. Each valve means 78, 82 is a self-contained check valve adjustably received in the housing 34. The spring pressure on each ball valve member is adjustable by way of a threaded member 83. Valve 78 communicates with the bore 51 by way of port 84. Similarly, valve means 82 communicates with bore 51 by way of port 86. See FIGS. 1 and 3. Since the check valves face in opposite directions, the pressure in bore 51, bore 46 and passage 66 will always be at an intermediate pressure between the pressure in conduit 72 and the pressure in conduit 74. In order to facilitate access to link 48 and pin 40, a plug 88 is removably attached to a bore 90 in the housing 34. See FIG. 1.

OPERATION

First Mode

Figure 2:
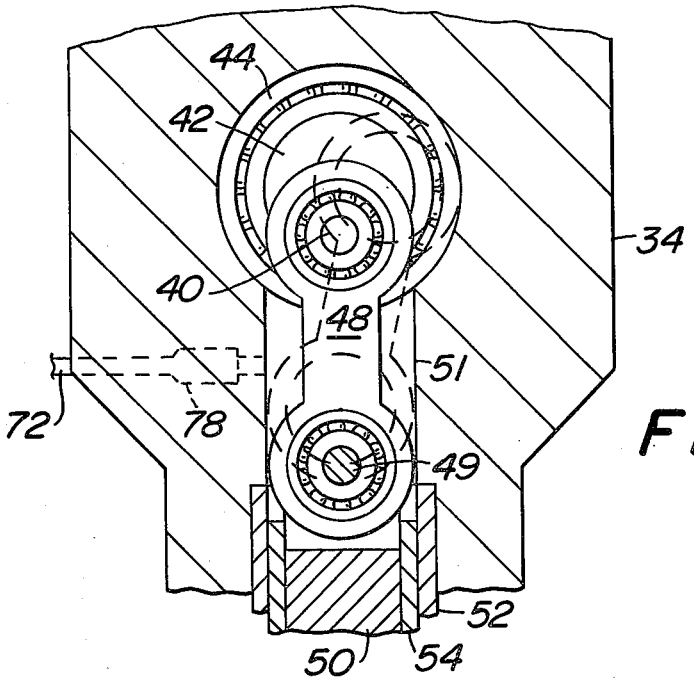
FIG. 2 is a sectional view taken along the line 2—2 in FIG. 1.

Displacer 16 is reciprocated between top dead center and bottom dead center by the piston 50, and link 48. Due to the structure as illustrated and described, there is no or minimal eccentric force on the piston 50 depending on the mode of operation. It will be noted that the link 48 moves between the solid line and phantom positions in FIG. 2. In the position shown in FIG. 1, the displacer 16 has been moved downwardly to bottom dead center by high pressure gas from conduit 72. The spool valve member 60 is held in the lower most position as shown in FIG. 1 by the cam 56.

The function of the regenerator 22 is to cool the gas passing downwardly there through and to heat gas passing upwardly there through. In passage downwardly through the regenerator the gases cooled thereby causing the pressure to decrease and further gas to enter the system to maintain the maximum cycle pressure. The decrease in temperature of the gas in chamber 20 is useful refrigeration which is sought to be attained by apparatus coupled to the heat station 28.

As the gas flows upwardly through the regenerator 22, it is heated by the matrix to near ambiant temperature thereby cooling the matrix. As the displacer 16 is moved upwardly from bottom dead center, cam 56 controls the intake portion of the cycle. Valve member 66 moves upwardly under the pressure of spring 62 and closes off port 68 while providing communication between passage 70 and port 76 as the displacer 16 approaches top dead center. Timing of the exhaust portion of the cycle is controlled by the contour of cam 56. As the displacer 16 approaches top dead center, passage 70 communicates with port 76 to thereby commence the exhaust portion of the cycle.

In the first mode described above it is assumed that motor 36 operated at full voltage and due to its small size only developed a torque such as 115 inch ounces. The cycle rate corresponds to the speed of motor 36 such as 200 rpm.

Second Mode—Hybrid

If the voltage applied to motor 36 is decreased so that its torque output is at a level such as 50–75 inch ounces. The motor 36 only influences the displacer 16 at top dead center and bottom dead center. The intermediate pressure existing in bores 46 and 51 is between the high pressure and low pressure associated with conduits 72, 74 respectively. Such intermediate pressure assists in moving the piston 50 downwardly as the displacer 16 moves from top dead center to bottom dead center and vice versa. This minimizes the force needed by the motor 36 to move the piston 50 and displacer 16 downwardly. The cycle speed exceeds the speed of motor 36. By modulating motor speed, the refrigerator 10 can have variable capacity. to dead center and bottom dead center.

Third Mode—Fluidic

If the voltage applied to motor 36 is further reduced so that the torque output is below about 25 inch ounces, the refrigerator 10 operates in a fluid mode. In this mode, the fluid pressure drives the motor 36 and reciprocates the displacer 16 so long as said low voltage is applied to motor 36. Motor 36 is inoperative in that it does not reciprocate the piston. At top dead center and bottom dead center, flywheel 45 provides the inertia for reversing the direction of movement of the displacer 16.

COMPARISON OF THE MODES

The size of the refrigerator 10 is only about 50% of the size of the refrigerator disclosed in the above mentioned co-pending application. In the first and second modes, eccentric forces are minimal and in the third mode there are no such forces. Hence, wear on bearing 52 is drastically reduced. In the third mode, the refrigerator 10 may operate in a high magnetic field. The refrigerator 10 will start in the first mode, and then convert to the third mode before the magnetic field is turned on. The second mode has the advantage of varying the refrigerator capacity. Each mode provides less noise and minimal vibration.

The present invention may be embodied in other specific forms without departing from the spirit or essential attributes thereof and, accordingly, reference should be made to the appended claims, rather than to the foregoing specification, as indicating the scope of the invention.

I claim:

1. In a cryogenic refrigerator in which a movable displacer means defines within an enclosure first and second chambers of variable volume, and in which a refrigerant fluid is circulated in a fluid path between the first chamber and the second chamber by movement of the displacer means, a piston connected to the displacer means, a motor connected to said piston for reciprocating said piston, a valve having a reciprocable valve member for controlling the flow of high and low pressure fluid to and from said chambers, said motor being arranged to reciprocate said valve member in timed relation with reciprocation of said piston so that the valve member will reverse the introduction of high pressure fluid into said first and second chambers when the displacer means is at one of the extremities of its movement, a third chamber exposed to a face of said piston, means associated with said high and low pressure fluids for maintaining the pressure in said third chamber intermediate the high and low pressures.

2. Apparatus in accordance with claim 1 including a cam driven by said motor, a roller bearing surrounding said cam, said roller bearing being in contact with said valve member, and spring means biasing said valve member toward said cam.

3. Apparatus in accordance with claim 1 including a link connected to an eccentric pin supported by an output shaft of said motor, said link being pivotally connected to one end of said piston and being disposed in said third chamber.

4. Apparatus in accordance with claim 1 wherein each of said high and low pressure fluids communicate with said third chamber by way of one of a pair of oppositely disposed check valves, said last mentioned means including said pair of valves.

5. In a cryogenic refrigerator in which a movable displacer means defines within an enclosure first and second chambers of variable volume, and in which a refrigerant fluid is circulated in a fluid path between the first chamber and the second chamber by movement of the displacer means, a piston connected to the displacer means, an electrical synchronous motor connected to said piston, a valve having a valve member for controlling the flow of high and low pressure fluid to and from said chambers, said motor being arranged to operate said valve member in timed relation with reciprocation of said piston so that the valve member will reverse the introduction of high pressure fluid into said first and second chambers when the displacer means is at one of the extremities of its movement, means for enabling said refrigerator to operate in a mode wherein said motor reciprocates said piston and in another mode wherein said motor is incapable of reciprocating said piston, said means including a third chamber exposed to a face of said piston, and valve means associated with said high and low pressure fluids for maintaining the pressure in said third chamber intermediate the high and low pressures.

6. Apparatus in accordance with claim 5 including a cam associated with said motor, a roller bearing surrounding said cam, said roller bearing being in contact with said valve member, and means biasing said valve member toward said cam.

7. Apparatus in accordance with claim 5 including a link connected to an eccentric pin supported by an output shaft of said motor, said link being pivotally connected to one end of said piston and being disposed in said third chamber.

8. Apparatus in accordance with claim 5 wherein each of said high and low pressure fluids communicate with said third chamber by way of one of a pair of oppositely disposed check valves, said last mentioned means including said pair of valves which constitute said valve means.

9. Apparatus in accordance with claim 5 wherein said enabling means includes a flywheel associated with said motor.

10. In a cryogenic refrigerator operable in plural modes and in which a movable displacer means defines within an enclosure first and second chambers of variable volume, and in which a refrigerant fluid is circulated in a fluid path between the first chamber and the second chamber by movement of the displacer means, a piston connected to the displacer means, a third chamber exposed to a face of said piston, a valve having a reciprocable valve member for controlling the flow of high and low pressure fluid to and from said chambers, means arranged to reciprocate said valve member in timed relation with reciprocation of said piston so that the valve member will reverse the introduction of high pressure fluid into said first and second chambers when the displacer means is at one of the extremities of its movement, means associated with said high and low pressure fluids for maintaining the pressure in said third chamber intermediate the high and low pressures, a synchronous motor for initiating reciprocation of said piston and having an output adjustable to a position incapable of driving said piston, and a means for storing kinetic energy for moving the piston past the extremities of its movement when said motor output is adjusted to said position.

11. Apparatus in accordance with claim 10 including a rotatable cam, a roller bearing surrounding said cam, said roller bearing being in contact with said valve member, and spring means biasing said valve member toward said cam.

12. Apparatus in accordance with claim 10 including a link connected to an eccentric pin supported by an output shaft of said motor, said link being pivotally connected to one end of said piston and being disposed in said third chamber.

13. Apparatus in accordance with claim 10 wherein each of said high and low pressure fluids communicate with said third chamber by way of one of a pair of oppositely disposed check valves, said last mentioned means including said pair of valves.

14. Apparatus in accordance with claim 10 wherein said kinetic energy storage means is a flywheel on a shaft of said motor.

* * * * *